US008651123B2

(12) United States Patent
Ferenz

(10) Patent No.: US 8,651,123 B2
(45) Date of Patent: Feb. 18, 2014

(54) UMBRELLA FOR HOLDING A GOLF CLUB

(76) Inventor: Jacob G Ferenz, Simpsonville, SC (US)

( * ) Notice: Subject to any disclaimer, the term of this patent is extended or adjusted under 35 U.S.C. 154(b) by 24 days.

(21) Appl. No.: 13/299,597

(22) Filed: Nov. 18, 2011

(65) Prior Publication Data

US 2013/0125941 A1 May 23, 2013

(51) Int. Cl.
*A45B 25/18* (2006.01)

(52) U.S. Cl.
USPC ..... 135/16; 135/33.2

(58) Field of Classification Search
USPC ..... 135/16, 33.2
See application file for complete search history.

(56) References Cited

U.S. PATENT DOCUMENTS

| | | | | |
|---|---|---|---|---|
| 2,681,070 | A * | 6/1954 | Ippolito | 135/16 |
| 4,711,260 | A * | 12/1987 | Wiens et al. | 135/16 |
| 4,880,023 | A * | 11/1989 | Lin | 135/15.1 |
| 5,158,102 | A * | 10/1992 | Lemcke | 135/16 |
| 5,673,718 | A | 10/1997 | Kennedy | |
| 6,227,216 | B1 * | 5/2001 | Dweck | 135/15.1 |
| 6,308,840 | B1 | 10/2001 | Mulholland et al. | |
| 7,011,100 | B2 * | 3/2006 | Wu | 135/16 |
| 7,478,643 | B2 * | 1/2009 | Hobson | 135/34.2 |
| 2004/0177872 | A1 * | 9/2004 | Guo | 135/33.7 |
| 2008/0163910 | A1 * | 7/2008 | Hollinger | 135/20.1 |

FOREIGN PATENT DOCUMENTS

WO WO 01/02062 A1 1/2001

OTHER PUBLICATIONS

European Patent Office; search report and opinion of the European Patent Office; Publisher is the European Patent Office, Rijswijk, Netherlands; European Application No. 12/92824.6-1653; copyright and mailing date Februiary 15, 2013, pp. 1-6, (6 pages).

* cited by examiner

*Primary Examiner* — Noah Chandler Hawk
(74) *Attorney, Agent, or Firm* — Metz Lewis Brodman Must O'Keefe LLC; Neal P. Pierotti

(57) ABSTRACT

An umbrella for use in receiving a golf club is provided that includes a stem and a frame carried by the stem. A canopy is supported by the frame and has an interior surface and an oppositely disposed exterior surface. The canopy defines a canopy aperture that extends completely through the canopy. A club receiving member is configured for receipt of at least a portion of a golf club and is arranged in relation to the canopy aperture such that at least a portion of the golf club is capable of being disposed through the canopy aperture and received by the club receiving member.

19 Claims, 9 Drawing Sheets

UMBRELLA FOR HOLDING A GOLF CLUB

FIELD OF THE INVENTION

The present invention relates generally to an umbrella for use in holding a golf club. More particularly, the present application involves an umbrella with an aperture through a canopy through which one or more golf clubs can be disposed and received within a sleeve while either holding the umbrella or while the umbrella is placed on the ground.

BACKGROUND

Golf is a popular recreational and professional sport that is enjoyed by millions of individuals across the globe. As it is an outdoor activity, rainfall often interferes with a round of golf and the golfer must always be prepared for golfing in inclement weather. Along these lines, golfers often employ protective equipment to help keep their golf clubs dry during rain as water on the golf club will hinder golf shots and will possibly result in degradation of portions of the golf clubs such as the grips and shafts. As such, to limit the effects of rainfall during a round of golf from detracting from a player's resulting score, it is desired to keep the golf clubs as dry as possible.

A standard item carried by all golfers is an umbrella that can be opened to shield the golf clubs from the rain. Umbrellas may be mounted to the back of a golf cart so that the open canopy extends over the golf clubs held by a golf bag on the back of the cart. The user will exit the golf cart and move the umbrella up vertically to allow room for him or her to pull a desired golf club out of the golf bag. Upward movement of the umbrella may allow rain to strike the golf club or may cause the golfer to be exposed to rain. The golfer will then carry the golf club in one hand and the umbrella in the other and walk to the specific location where the shot is to be taken. The golf club may become wet through rainfall when carried by the hand of the golfer when walking under the umbrella. The golfer could inadvertently move the golf club from under the canopy or rain could blow in under the canopy of the umbrella to get the grip or other portion of the golf club wet.

Various attempts to keep a golf club dry during inclement weather have been attempted. One such design involves fitting an attachment mechanism to the frame of the umbrella that is under the canopy of the umbrella. A golf club is attached to the attachment mechanism and the user can hold a grip of the umbrella and walk to the desired spot while the golf club remains held by the attachment mechanism. With such a configuration, it is difficult to close the umbrella because the presence of the attachment mechanism or even golf club within the attachment mechanism will interfere with the frame when moving into the closed position. Also, the user will have to move the umbrella vertically upwards when inserting the golf club into the attachment mechanism because additional room is needed to transfer the golf club from the golf bag to the attachment mechanism.

Another device known to assist golfers in golfing during the rain involves the provision of a clip device attached to the stem of the umbrella. One or more golf clubs are attached to the clip device and hence retained onto the umbrella. The user can then walk to a desired location, remove either one of the golf clubs, and then make a golf shot. However, upon putting down the umbrella, the golf club that is still retained on the clip device will become wet. Further, the clip device and retained golf clubs will interfere with the user grasping the handle of the umbrella. Further, with such a device it is difficult to close the umbrella because the clip device may prevent a sliding component of the frame from moving back towards the handle of the umbrella to effect closure of the canopy. As such, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
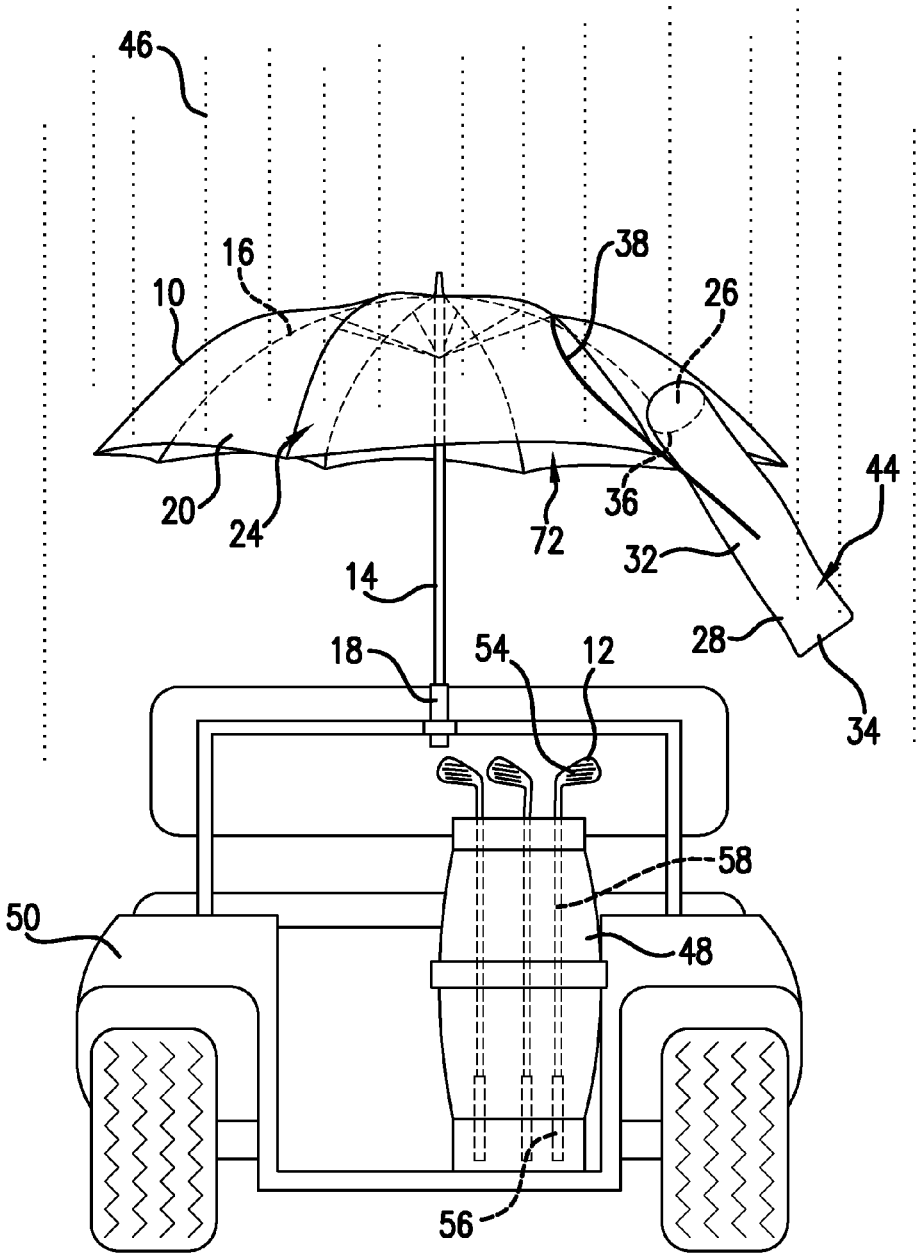
FIG. 1 is a front elevation view of an umbrella in an open position with a golf club not retained by the umbrella.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for an umbrella 10 that is used to receive a golf club 12 to keep the golf club 12 dry during inclement weather. The umbrella 10 features a club receiving member 28 that receives the golf club 12. In some versions, the club receiving member 28 may extend from an exterior surface 24 of a canopy 20 of the umbrella 10 and can be a flexible sleeve. The golfer 52 can place the golf club 12 within the club receiving member 28 and keep it there until he or she needs the golf club 12 to make a shot. When located within the club receiving member 28, the golf club 12 is protected from rain 46. In some versions, the user 52 may maintain a grip on the golf club 12 when it is received within the club receiving member 28. In other uses of the umbrella 10, the golfer 52 need not hold the golf club 12 when it is within the club receiving member 28. Here, the golf club 12 can via its own weight can be retained within the club receiving member 28 and retained therein. Such an arrangement affords the user 52 more flexibility when using the umbrella 10 and may prevent the umbrella 10 from blowing away in the wind when it is placed on the ground when the golfer 52 takes a shot due to being weighed down by the golf club 12.

An umbrella 10 in accordance with one exemplary embodiment is disclosed with reference to FIG. 1. A golf club bag 48 that holds a set of golf clubs is attached to the back of a golf cart 50 in a known manner. The golf cart 50 may be provided with an attachment that allows a handle 18 or stem 14 of the umbrella 10 to be attached and mounted to the golf cart 50. The umbrella 10 is in an open position in which a canopy 20 of the umbrella 10 covers the golf club bag 48 and prevents rain 46 from getting onto the golf club bag 48 and golf clubs within the golf club bag 48. In some instances, a separate cover can be located over the golf clubs within the golf club bag 48 so that the golf clubs in the golf club bag 48 are further protected against the rain 46. Once the user 52 removes the umbrella 10 from the golf cart 50, the separate cover on the golf club bag 48 will protect the golf clubs within the golf club bag 48 from getting wet by the rain 46.

The umbrella 10 includes a frame 16 that is carried by the stem 14. The frame 16 may be made of metal and supports the canopy 20. The canopy 20 can be made of a material that does not allow water to pass therethrough. In some embodiments the canopy 20 is made of a flexible plastic that prevents water from passing therethrough and can be folded up into a closed position and opened up into an open position. In the open position illustrated in FIG. 1, the canopy 20 covers the golf club bag 48 and prevents rain 46 from falling onto the golf clubs within the golf club bag 48. A club receiving member 28 is carried by the canopy 20 and is shown laying on an exterior surface 24 of the canopy 20. During rainfall, rain 46 engages an exterior surface 44 of the club receiving member 28 and gets the exterior surface 44 wet. In the embodiment disclosed in FIG. 1, the club receiving member 28 is a flexible sleeve that has a distal end 34 that is closed. As such, the distal end 34 is closed, and the length of the club receiving member 28 from the distal end 34 extending back towards the canopy 20 is closed around its perimeter so that rain 46 is prevented from penetrating into an interior 32 of the club receiving member 28. The club receiving member 28 can take on a variety of different shapes due to its inherent flexibility. The club receiving member 28 may be of such a length that it hangs over the edge of the canopy 20 and thus extends beyond the perimeter of the exterior surface 24 of the canopy 20.

Figure 2:
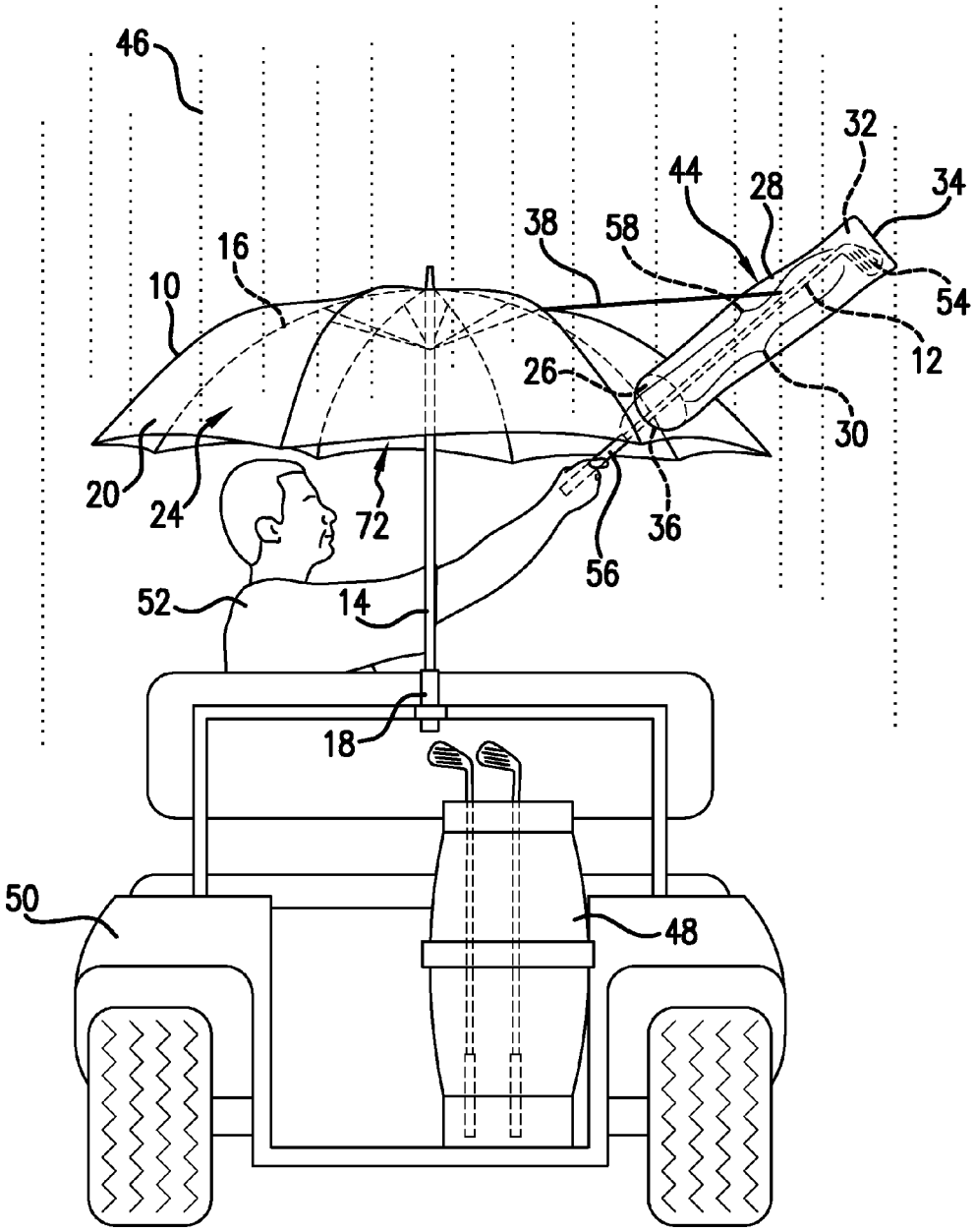
FIG. 2 is a front elevation view of the umbrella of FIG. 1 with the golf club retained by the umbrella.

The umbrella 10 allows the user 52 to take a golf club 12 from the golf club bag 48 and keep it dry at all times before he or she actually uses the golf club 12 to take a shot. With reference now to FIG. 2, the user 52 can grab the golf club 12 and pull it from the golf club bag 48 and position the golf club 12 within the club receiving member 28. The user 52 can grasp the golf club 12 by the grip 56 of the golf club 12 and maintain the position of the golf club 12 within the club receiving member 28. As the club receiving member 28 is a flexible sleeve in the embodiment disclosed, the club receiving member 28 will accommodate the shape of the golf club 12 as the user 52 positions it therein. The golf club 12 can be pulled up from the golf club bag 48 and located within the club receiving member 28 without having to move the umbrella 10 upwards vertically to accommodate the length of the golf club 12. This may allow the golf club 12 and golf clubs in the golf club bag 48 to remain dryer since the umbrella 10 does not have to be moved vertically upwards during rainfall.

The user can grasp the handle 18 of the umbrella 10 with his or her other hand and carry both the golf club 12 and the umbrella 10 to a desired location while holding one in each hand. This arrangement keeps the golf club 12 dry due to the fact that a portion of the golf club 12 is under the interior surface 22 of the canopy 20 and in a dry space 72, and because the remaining portion 30 of the golf club 12 is within the interior 32 of the club receiving member 28 and likewise shielded from rain 46. Once the user 52 is at a desired location, he or she can remove the golf club 12 from the club receiving member 28 and put down the umbrella 10 and take a shot as desired. The club receiving member 28 allows the user 52 to expose the golf club 12 to the rain 46 only when taking a shot, and not when transitioning the golf club 12 from the golf club bag 48 to under the umbrella, or when walking with the golf club 12 under the umbrella to the desired position.

Although described in relation to a golf cart 50, the golf club bag 48 could be used with a pull cart or simply carried by the golfer or caddie on his or her shoulder in other embodiments. Here, the umbrella 10 could be attached to the pull cart or to the golf club bag 48 or could be simply held by the hand of the user 52. The user 52 may grasp and pull the golf club 12 from the golf club bag 48 and insert same into the club receiving member 28 in the same manner as previously described in order to transport the golf club 12 to a desired location for a shot.

Figure 3:
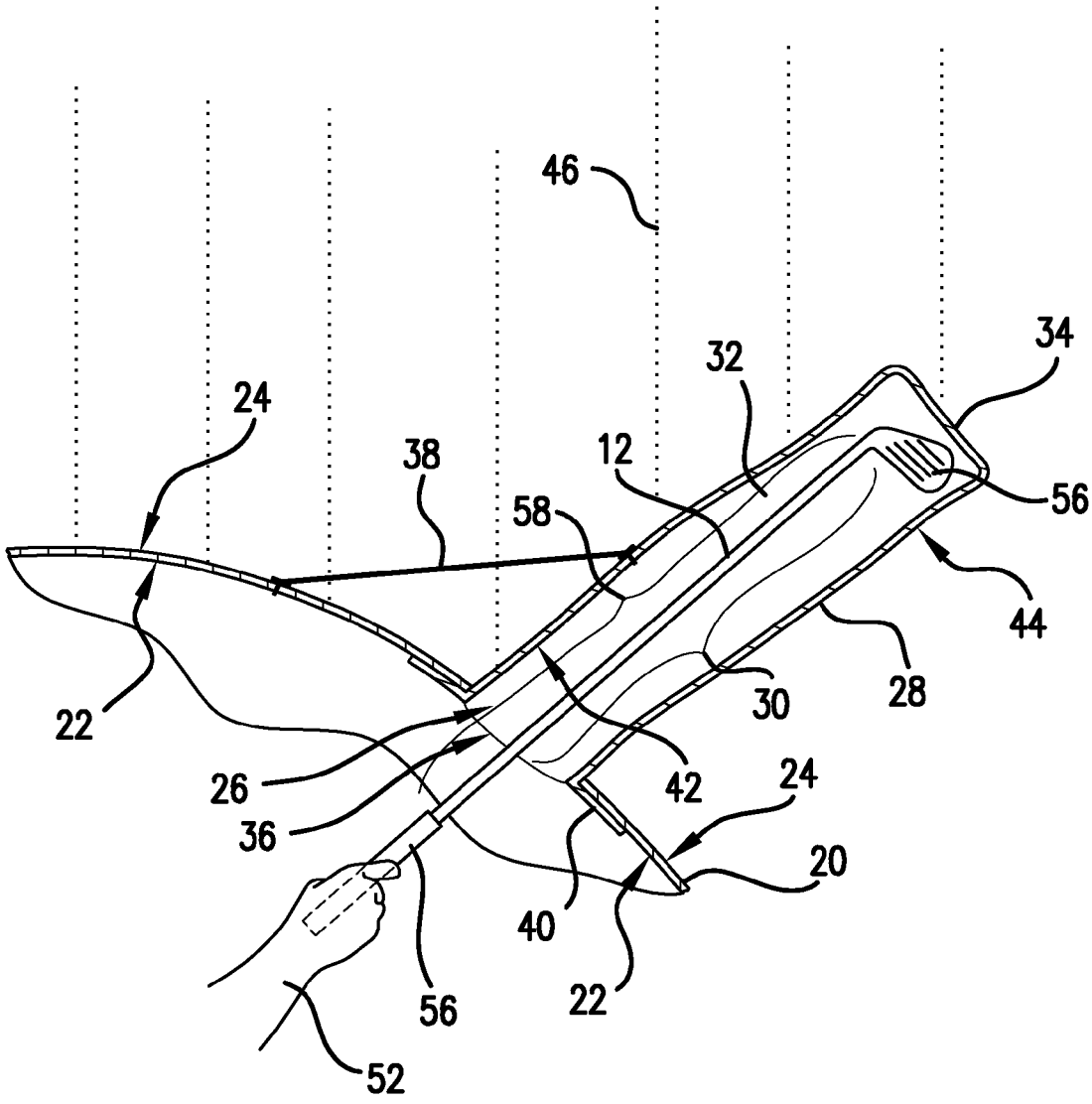
FIG. 3 is a cross-sectional view of a club receiving member with a portion of a golf club disposed therein.

The club receiving member 28 is shown in greater detail as illustrated in FIG. 3 which is a cross-sectional view of the club receiving member 28 when receiving a portion 30 of the golf club 12. The golf club 12 includes a head 54 that is within the interior 32 and that engages the interior surface 42 of the club receiving member 28. The shaft 58 of the golf club 12 may also be located within the interior 32 and engage the interior surface 42. The head 54 and a portion of the shaft 58 may make up the portion 30 of the golf club 12 that is received within the club receiving member 28. The grip 56 and a portion of the shaft 58 may be located outside of the interior 32 and thus may not be received within the club receiving member 28 or engage its interior surface 42 and may thus not be a part of the portion 30. Various arrangements are possible in other exemplary embodiments. For example, the entire shaft 58 may be located within the interior 32 in other embodiments such that only the grip 56 is not within the interior 32. In still other exemplary embodiments, a portion of the grip 56 may in fact be received within the interior 32 such that a portion of the grip 56 makes up portion 30. In yet additional exemplary embodiments, the entire golf club 12 is located within the interior 32 so that the entire golf club 12 is within the club receiving member 28. The various portions of the golf club 12 that are within the interior as previously discussed may or may not engage the interior surface 42 in accordance with different exemplary embodiments.

The canopy 20 has an exterior surface 24 and an oppositely disposed interior surface 22. The rain 46 engages the exterior surface 24 and gets this surface wet, but does not engage or get wet the interior surface 22. A canopy aperture 26 is disposed through the canopy 20 and extends completely from the interior surface 22 to the exterior surface 24 such that the canopy 20 is essentially discontinuous at this location. The interior 32 of the club receiving member 28 is in communication with the canopy aperture 26. In this regard, the interior 32 is an open space that is contiguous or opens into the open space of the canopy aperture 26 such that the golf club 12 can extend through the canopy aperture 26 and into the interior 32.

The club receiving member 28 can be a separate component that is attached to the canopy 20 in a variety of manners. For example, the club receiving member 28 can be attached to the canopy 20 by adhesion, hook and loop fasteners, sonic welding, mechanical fasteners, sewing, stitching, or any other mechanism. Further, the canopy 20 and club receiving member 28 can be integrally formed with one another such that they are in effect a single component. It is to be understood that the club receiving member 28 can be a separate component attached to the canopy 20 via any different number of attachments, or may be integrally formed with the canopy 20 in accordance with yet additional exemplary embodiments.

As disclosed in FIG. 3, the club receiving member 28 has a flange 40 at its proximal end 36. The proximal end 36 of the club receiving member 28 is open and may be located at or just proximal to the canopy aperture 26. The open proximal end 36 of the club receiving member 28 is in communication with the open interior 32 so that the golf club 12 can be inserted through the open proximal end 36 and into the open interior 32. The flange 40 engages the interior surface 22 of the canopy 20 and is attached to the interior surface 22 via stitching. In other arrangements, the flange 40 could be attached to the exterior surface 24. In yet other exemplary embodiments, a pair of flanges 40 may be present and one can be attached to the interior surface 22 and the other can be attached to the exterior surface 24. The flange 40 may be integrally formed with the length of the club receiving member 28 such that the entire club receiving member 28 is a single component. The club receiving member 28 could be formed by any method and may in other embodiments be a plurality of pieces attached to one another.

Figure 4:
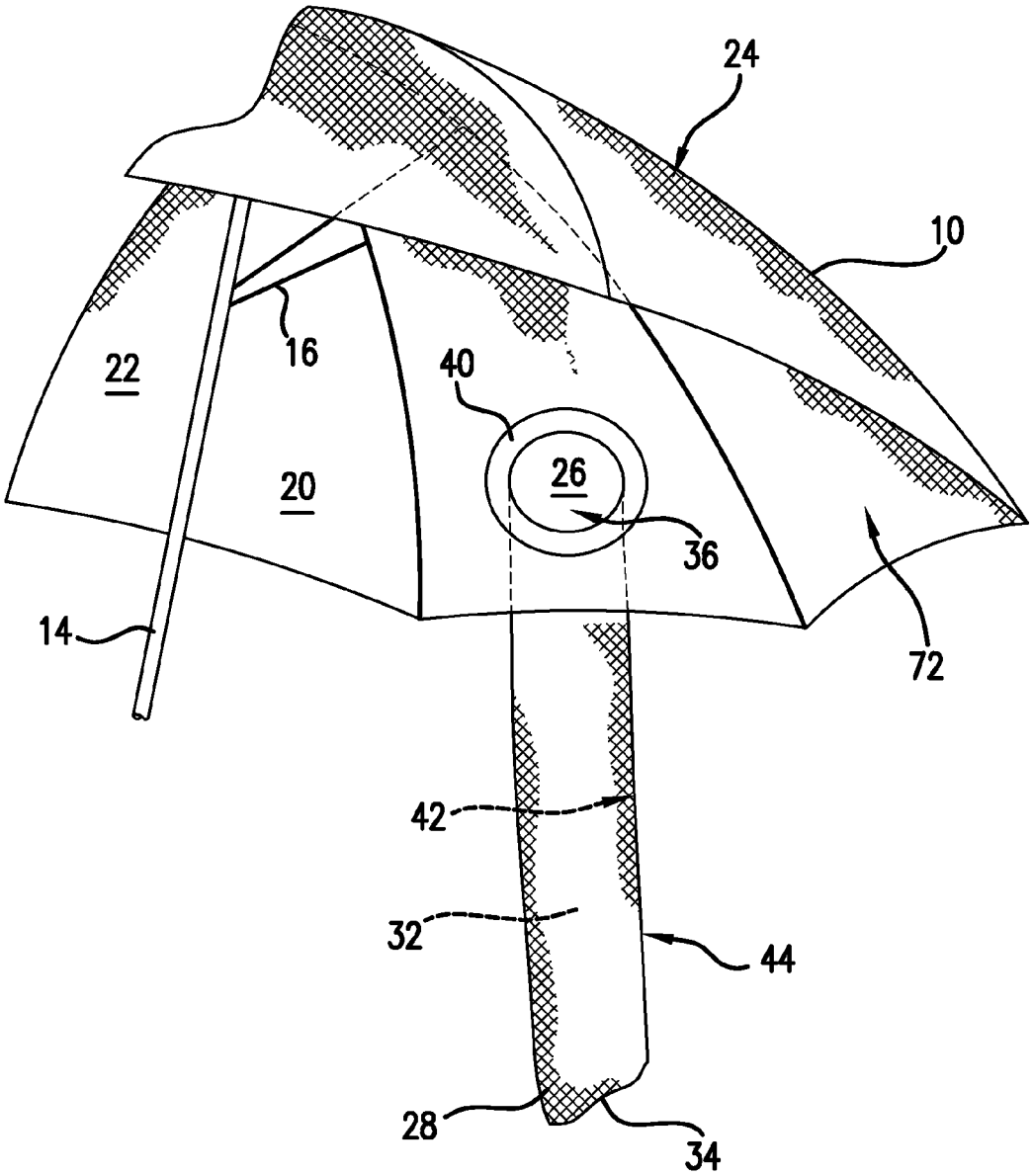
FIG. 4 is a front elevation view of a portion of an interior surface of a canopy of an umbrella.

FIG. 4 is an interior view of the umbrella 10 that shows a portion of the interior surface 22 of the canopy 20 that has the club receiving member 28. As disclosed, the canopy aperture 26 is circular in shape, and the flange 40 is likewise circular. The flange 40 is continuous about its entire outer perimeter and engages the interior surface 22 so as to completely encircle the perimeter of the canopy aperture 26 if the canopy aperture 26 were to extend in the proximal direction. The canopy aperture 26 is located at an area of the canopy 20 that is between two of the frame 16 members that extend down towards the perimeter of the canopy 20. The length of the club receiving member 28 is a flexible sleeve that lays against the exterior surface 24 and as shown may hang down below the perimeter of the canopy 20. The interior 32 can have the same cross-sectional size and shape as that of the open proximal end 36. As such, the interior 32 may have a cross-sectional shape that is circular from its proximal end 36 all the way to its distal end 34. However, it is to be understood that in accordance with other exemplary embodiments that the size and/or cross-sectional shape of the interior 32 could be variously provided in other embodiments and that the disclosed arrangement is only exemplary.

With reference back to FIG. 3, the umbrella 10 may also include a retaining member 38. The retaining member 38 is disclosed as a string in the embodiment illustrated, but could be variously configured in accordance with other exemplary embodiments. Further, it is to be understood that in yet additional arrangements, the retaining member 38 need not be present. The retaining member 38 may be attached on one end to the exterior surface 24 of the canopy 20. Any mechanism may be used to effect attachment of the retaining member 38 to the canopy 20. For example, a flap may be present on the canopy 20 through which the retaining member 38 is disposed. As disclosed, a pin is disposed through the canopy 20, and the retaining member 38 is fastened to the pin. In yet other arrangements, there can be one or more holes through the canopy 20 and the retaining member 38 may be looped or inserted through the one or more holes and attached thereto. The terminal end of the retaining member 38 is attached to the canopy 20 so that its position at the terminal end does not change relative to the canopy 20. The length of the retaining member 38 extends from the terminal end to the club receiving member 28.

The opposite terminal end of the retaining member 38 is attached to the exterior surface 44 of the club receiving member 28. The retaining member 38 may be attached to the club receiving member 28 in a variety of manners as previously discussed with the attachment of the opposite terminal end and the canopy 20 and a repeat of this information is not necessary. As disclosed, a pin extends through the club receiving member 28 and the terminal end of the retaining member 38 is fastened to the pin so that the terminal end of the retaining member 38 is attached to the club receiving member 28. The terminal end of the retaining member 38 thus does not change positions relative to the club receiving member 28 at its point of attachment. The length of the retaining member 38 is flexible due to the fact that the retaining member 38 is a flexible string such that it can change positions and orientations with respect to the canopy 20 and the club receiving member 28. The retaining member 38 may be attached at the half-way point of the length of the club receiving member 28. However, in other arrangements, the retaining member 38 can be attached at any point along the length of the club receiving member 28 such as at the distal end 34 or at a location just distal to the exterior surface 24 such that the retaining member 38 is attached to the club receiving member 28 at a location that almost touches the exterior surface 24 as shown in FIG. 3.

The retaining member 38 may or may not be pulled taut when the club receiving member 28 is fully extended based upon insertion of the golf club 12. The retaining member 38 functions to prevent either all or a portion of the club receiving member 28 from being pulled back into the umbrella 10 when the user 52 removes the golf club 12 from the club receiving member 28 when he or she needs to use the golf club 12 to make a shot. Due to the flexibility of the club receiving member 28, the head 54 of the golf club 12 or other portions of the golf club 12 may catch on or otherwise frictionally engage the interior surface 42 and pull the club receiving member 28 back through the canopy aperture 26 when removing the golf club 12.

Figure 5:
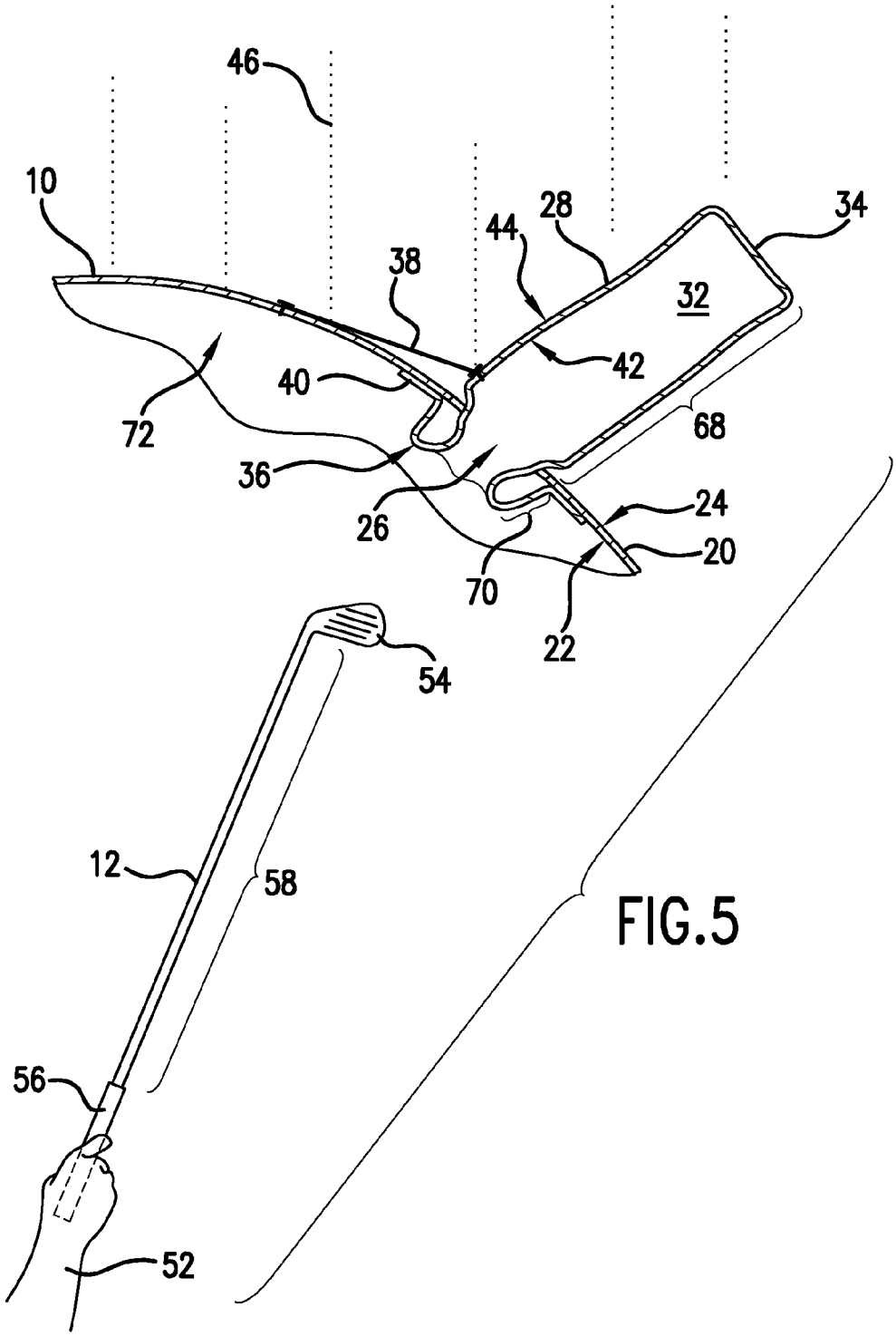
FIG. 5 is a cross-sectional view similar to FIG. 3 but with the golf club removed from the club receiving member.

The user 52 can pull the golf club 12 out of the club receiving member 28 as illustrated with reference to FIG. 5. A portion 70 of the club receiving member 28 may be pulled by the head 54 back through the canopy aperture 26 into the dry space 72 of the umbrella 10 defined by the interior surface 22. Pulling of the club receiving member 28 causes the attached retaining member 38 to likewise be moved and eventually pulled taut as disclosed in FIG. 5. At this point, the retaining member 38 cannot be pulled any further and the club receiving member 28 will be prevented from further movement. A portion 68 of the club receiving member 28 will not be pulled back through the canopy aperture 26 due to the presence of the retaining member 38. A portion of the retaining member 38 itself may be pulled through the canopy aperture 26 or may not be pulled through the canopy aperture 26 and may remain outside of the umbrella 10. $B_y$ preventing the entire club receiving member 28 from being pulled through the canopy aperture 26, an opening into the interior 32 can still be discernable by the user 52 so that he or she may be able to easily reinsert the golf club 12 into the club receiving member 28. If the entire club receiving member 28 were pulled through the canopy aperture 26, it may be the case that the club receiving member 28 would be pulled inside out thus requiring the user 52 to first properly reconfigure the club receiving member 28 and then second reinsert the golf club 12. However, it is to be understood that in accordance with certain exemplary embodiments, the retaining member 38 is not present, and the club receiving member 28 may or may not be pulled completely through the canopy aperture 26 possible causing it to be pulled inside out upon removal of the golf club 12.

Figure 6:
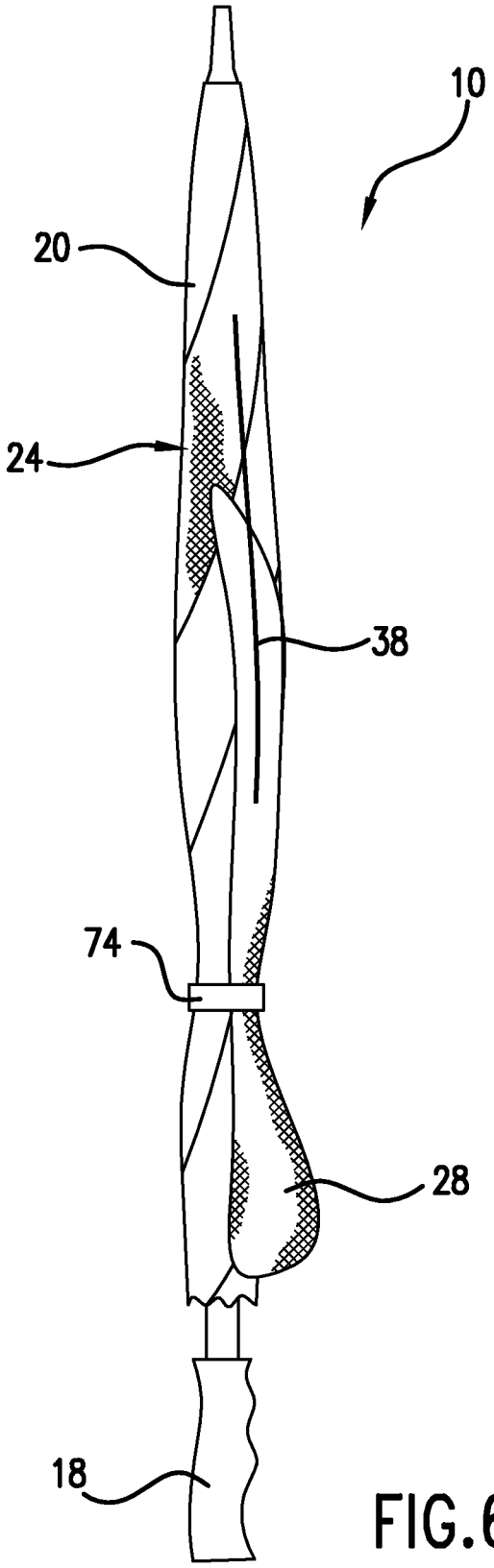
FIG. 6 is a front elevation view of the umbrella of FIG. 1 in a closed position.

Due to the flexible nature of the club receiving member 28 and the retaining member 38 if present, the umbrella 10 can be moved into the closed position in the normal manner without interference from these components. FIG. 6 shows the umbrella 10 once the user 52 is finished with the umbrella 10 and manipulates the frame 16 so that the canopy 20 is moved into the closed position. The flexible club receiving member 28 and retaining member 38 lay against the exterior surface 24. A tie 74 of conventional arrangement can be wrapped around the members 28, 38 and exterior surface 24 and attached to itself in a known manner to secure these elements into the closed position of the umbrella 10 for transport or storage. It is to be understood that the club receiving member 28 and the retaining member 38 are described as being "flexible" in that their shape can change into various positions although their ultimate size cannot be extended past a maximum length.

Figure 7:
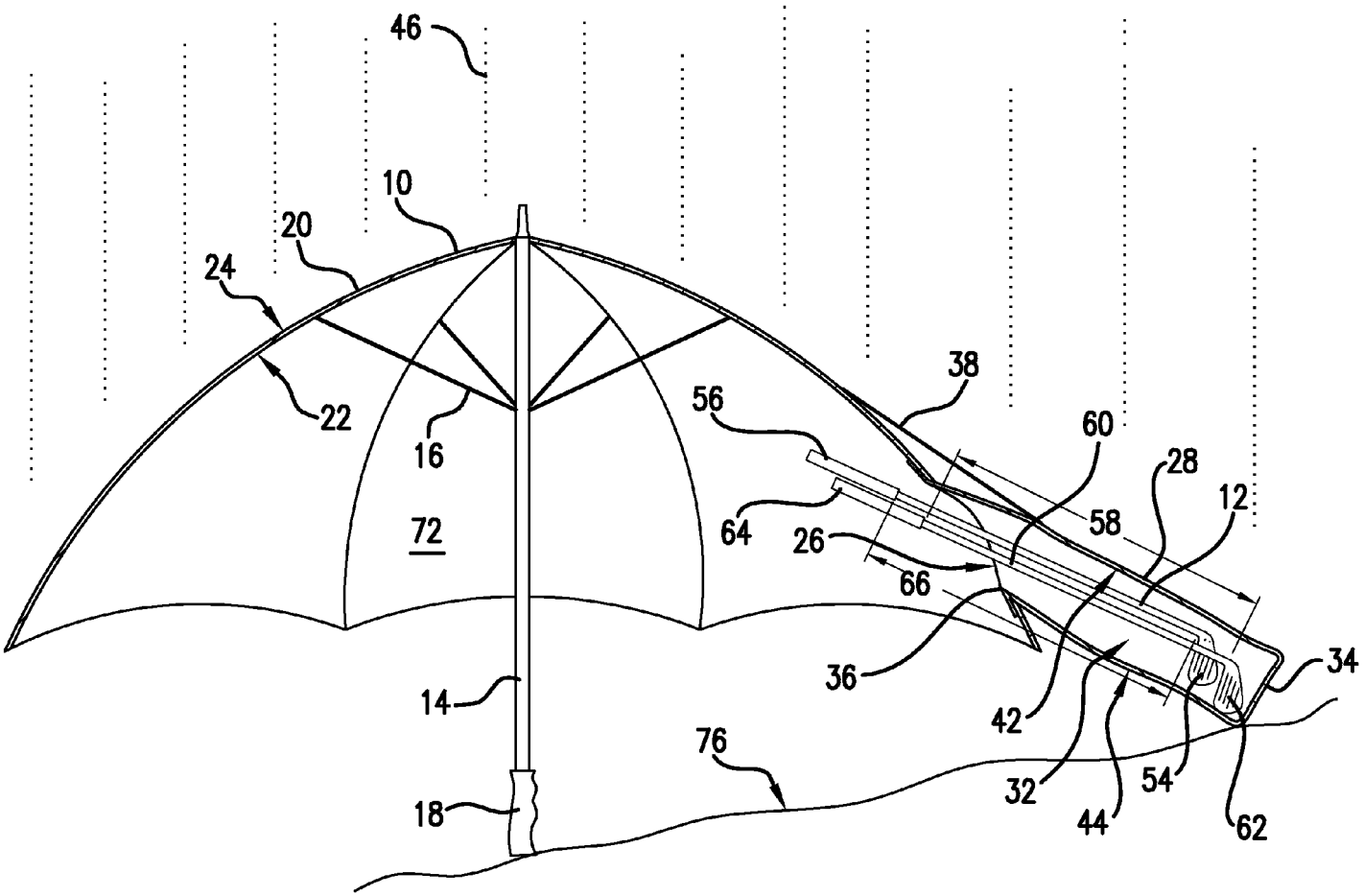
FIG. 7 is a cross-sectional view of an umbrella with a pair of golf clubs retained in the club receiving member without being held by a user.

Although described as having a single golf club 12 retained within the club receiving member 28, any number of golf clubs can be retained in accordance with different exemplary embodiments. FIG. 7 shows the umbrella 10 with a first golf club 12 and a second golf club 60 located within the club receiving member 28. In this exemplary embodiment, the golf clubs 12 and 60 are not held $b_y$ the user 52 but are instead retained completely by the umbrella 10 without the need for the user 52 to grasp or touch either of the golf clubs 12 and 60. The golf clubs 12 and 60 can be inserted into the interior 32 so that the heads 54 and 62 of the golf clubs 12 and 60 are each located within the interior 32. Portions of or all of the shafts 58 and 66 of the golf clubs 12 and 60 may likewise be located within the interior 32 and with the heads 54 and 62 engage the interior surface 42. The grips 56 and 64 may be located outside of the interior 32 and can instead be located within the dry space 72. However, in accordance with other exemplary embodiments all of the golf clubs 12 and 60 can be located within the interior 32 and none of the golf clubs 12 and 60 can be located within the dry space 72. Portions of the golf clubs 12 and 60 that are in the interior 32 can engage one another.

As disclosed in FIG. 7, the weight of the golf clubs 12 and 60 cause the exterior surface 44 to engage the exterior surface 24 such that the club receiving member 28 in effect lays on top of the canopy 20. The canopy 20 and frame 16 are constructed in a robust manner to accommodate the weight of the golf clubs 12 and 60 in this orientation and to accommodate flexing or bending of the frame 16 and canopy 20 due to this weight. The grips 56 and 64 may in turn engage the interior surface 22. However, in other arrangements, one or both of the grips 56 and 64 need not actually contact the interior surface 22 but could instead simply contact the other grip 56 or 64 or be located within the interior 32 or simply be located within the dry space 72 without engaging the canopy 20. However, engagement with the interior surface 22 on one side and against or towards the exterior surface 24 at their lower ends functions to create a wedge like fit of the golf clubs 12 and 60 so that they are securely held in place.

The user 52 can walk around with the umbrella 10 while holding the handle 18 without touching the golf clubs 12 and 60 as they are securely retained within the club receiving member 28. The user 52 may place the umbrella 10 down onto the ground and the golf clubs 12 and 60 will remain dry within the club receiving member 28 and will be elevated off of the ground so that their grips 56 and 64 do not engage the ground and become wet. The added weight of the golf clubs 12 and 60 within the umbrella 10 will function to weigh down the umbrella 10 to prevent it from blowing away should a strong wind suddenly hit the umbrella 10 while the umbrella 10 is on the ground. The arrangement in FIG. 7 could be used instead of the hand held arrangement in FIGS. 2 and 3, or the club receiving member 28 could be constructed so that it could be used in both of these embodiments.

Although described as holding a pair of golf clubs 12 and 60, any number of golf clubs could be retained within the club receiving member 28 in other exemplary embodiments. For example, from 1-5, from 6-10, or up to 15 golf clubs could be retained in accordance with other exemplary embodiments. Further, although but a single club receiving member 28 is illustrated, it is to be understood that in other embodiments and number of club receiving members 28 could be included with the umbrella 10 such as from 1-3, from 4-6, or up to 8 club receiving members 28 could be incorporated into the umbrella 10. In some instances, the user 52 could hold onto the golf club 12 and position it within the club receiving member 28 with one hand, while the second golf club 60 is not held by the user 52 and is simultaneously retained within the club receiving member 28.

The umbrella 10 of the embodiment of FIG. 7 has a retaining member 38 that functions in the same manner as previously described and a repeat of this information is not necessary. However, the retaining member 38 in the embodiment of FIG. 7 is not attached on one terminal end to the canopy 20, but is instead attached to the top of the stem 14 of the umbrella 10. The portion of the stem 14 to which the retaining member 38 is attached is not a portion located under the canopy 20 and hence in the dry space 72, but is instead a portion of the stem 14 that is above the canopy 20 and outside of the exterior surface 24 and is at the very top of the umbrella 10.

Although described as extending from the exterior surface 24, the club receiving member 28 could be variously arranged with respect to the components of the umbrella 10 in other arrangements. For example, the club receiving member 28 could be suspended from the interior surface 22 of the canopy 20 and be completely within the dry space 72 such that a canopy aperture 26 is not present and such that no portion of the club receiving member 28 is beyond the exterior surface 24. Here, the club receiving member 28 still functions to keep the golf club 12 dry during rainfall because rain 46 could blow sideways under the canopy 20 and into the dry space 72. The club receiving member 28 may function as a backup device to keep the golf club 12 dry. The club receiving member 28 may be attached or engage any component or combination of components of the umbrella 10 such as the stem 14, frame 16, handle 18, or canopy 20 in accordance with various exemplary embodiments. As such, as used herein the club receiving member 28 can still function to keep the golf club 12 dry during rain 46 even when the club receiving member 28 itself is not actually being engaged by rain 46 during rainfall.

Further, although described as being a flexible sleeve, the club receiving member 28 need not be flexible in other embodiments, and need not be a sleeve in other embodiments. The club receiving member 28 may be a series of straps, a rigid hook like member, or a resilient block that has an aperture that retains the golf club 12 therein through a frictional type fit. Also, when configured as a flexible sleeve, the club receiving member 28 need not have an exterior surface 44 that is closed from the proximal end along its length with a closed distal end 34. Instead, the club receiving member 28 may have one or more apertures along its length, and may have one or more apertures that extend from the interior surface 42 to the exterior surface 44 at the distal end 34. As such, it is to be understood that the club receiving member 28 need not be waterproof and may allow rain 46 to engage the golf club 12 in certain exemplary embodiments. Advertising or trademark indicia could be located on the exterior surface 44.

The golf club 12 may be kept dry during rain 46 such that a portion of the golf club 12 is kept dry by the canopy 20 and the rest of the golf club 12 is kept dry by the club receiving member 28. Alternatively, one of the canopy 20 or club receiving member 28 can prevent rain 46 from engaging the golf club 12 while the other one 20 or 28 does not directly prevent rain 46 from engaging the golf club 12. However, the one 20 or 28 that does not directly prevent rain 46 from engaging the golf club 12 still functions to keep the golf club 12 dry during rainfall because it indirectly prevents rain 46 from engaging the golf club 12 via either a backup role or by shielding against rain 46 that could blow in sideways or even vertically upwards or through the other component 20 or 28 to the golf club 12. As such, as used herein, the ability of one of the canopy 20 or club receiving member 28 to keep the golf club 12 dry during rainfall may be achieved even if the member 20 or 28 does not directly cover the golf club 12 and block rain 46 that would otherwise contact the golf club 12.

Although described as being retained within the club receiving member 28 when the umbrella 10 is in the open position, the golf club 12 may remain retained within the club receiving member 28 even when the umbrella 10 is changed back into the closed position.

Figure 8:
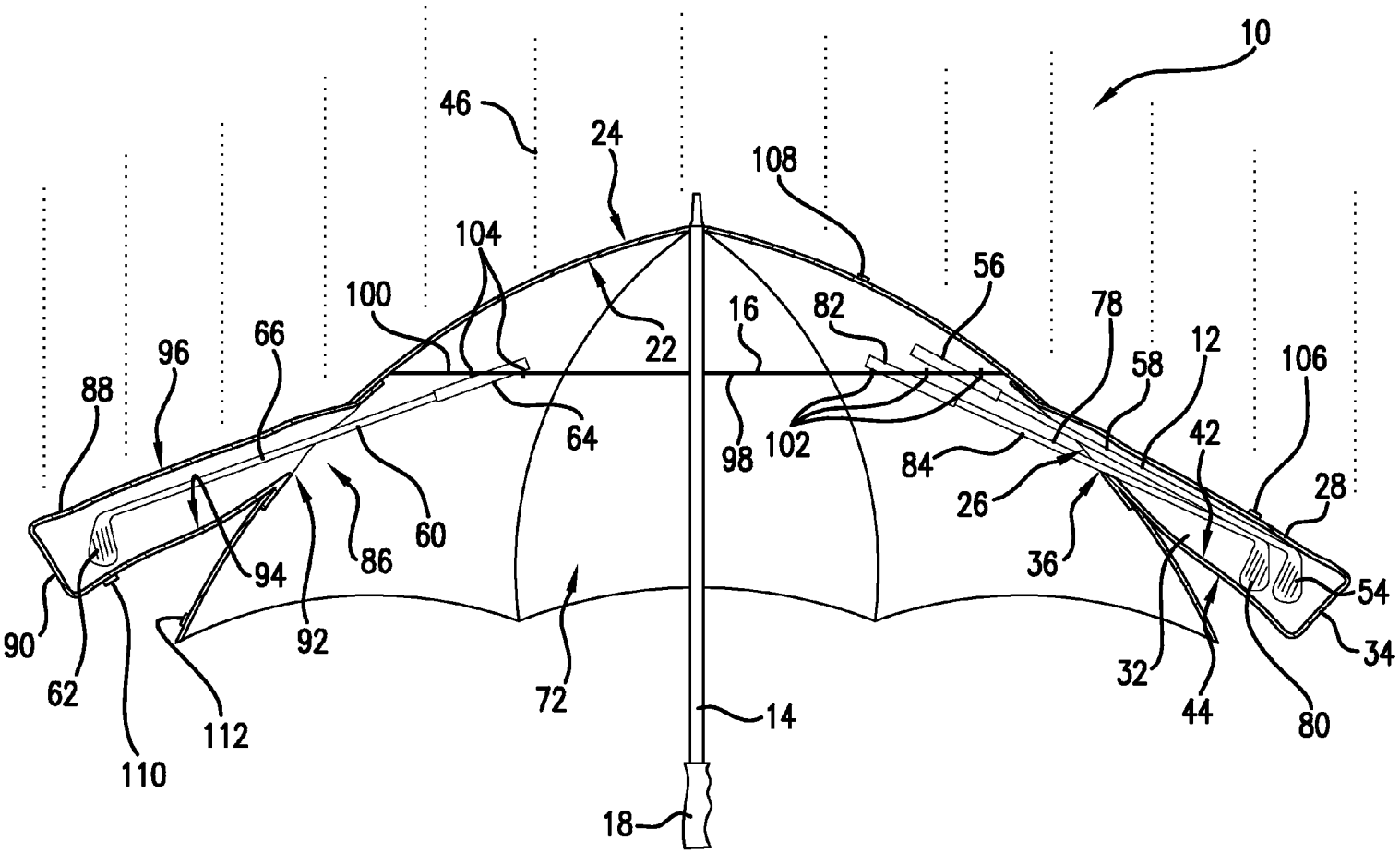
FIG. 8 is a cross-sectional view of an umbrella with a pair of club receiving members in accordance with another exemplary embodiment.
Figure 9:
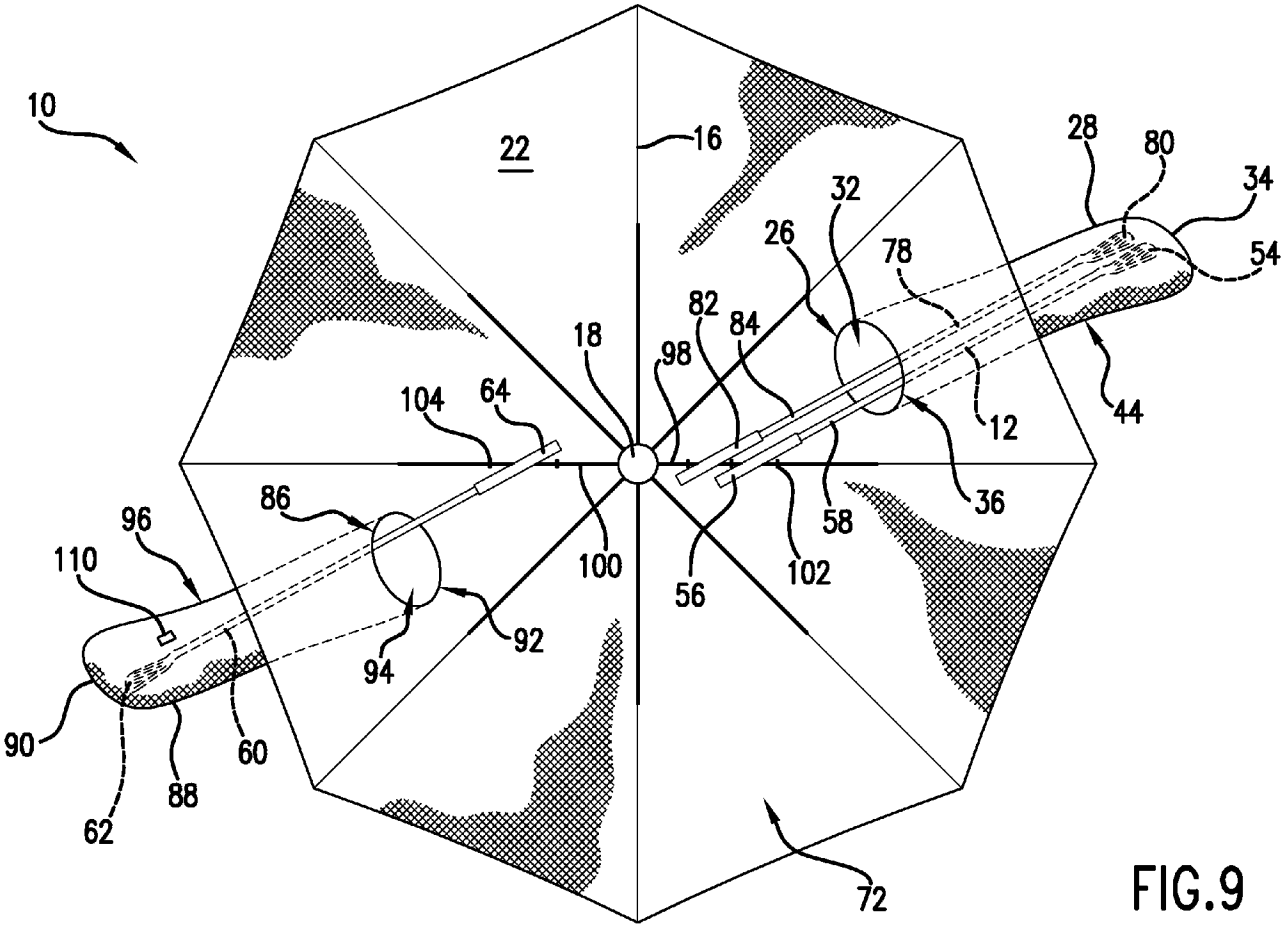
FIG. 9 is a bottom view of the umbrella of FIG. 8.

An additional exemplary embodiment of the umbrella 10 is shown with reference to FIGS. 8 and 9. It may be the case that carrying two or more golf clubs within a single club receiving member 28 may cause an imbalance in the weight of the umbrella 10 that may make it hard for a user 52 to hold. In these instances, the weight of two or more golf clubs will cause the umbrella 10 to be awkward to hold thus forcing the user 52 to exert force to counterbalance the weight of the golf clubs. In accordance with one exemplary embodiment, a second club receiving member 88 is provided as is positioned on the umbrella 10 at a location that is 180° from the first club receiving member 28 about the axis of the stem 14. A second golf club 60 may be placed within the second club receiving member 88 in order to balance the weight of the first golf club 12 within the first club receiving member 28. With this configuration, the umbrella 10 will be more evenly balanced and will be easier for the user 52 to carry.

The second club receiving member 88 extends from a second canopy aperture 86 defined through the canopy 20 that may be located 180° from the first canopy aperture 26 about the axis of the stem 14. The second golf club 60 is disposed through the second canopy aperture 86 and retained within the second club receiving member 88. The weight of the second golf club 60 may cause a portion of the exterior surface 96 to rest against the exterior surface 24. The second golf club 60 will extend from the proximal end 92 and into the second club receiving member 88 and will engage the interior surface 94. The length of the second club receiving member 88 may be such that it extends beyond the perimeter of the canopy 20 and thus off of the canopy 20. The distal end 90 can be spaced from the outer perimeter of the canopy 20. The second golf club 60 can be arranged within the interior of the second club receiving member 88 so that the head 62 faces downwards. This arrangement may prevent bunching up of the second club receiving member 88 when the second golf club 60 is removed from the second club receiving member 88. However, in other exemplary embodiments, the head 62 may face upwards or sideways.

The second golf club 60 extends into the dry space 72 such that its grip 64 engages a horizontal spoke 100 of the frame 16. The weight of the second golf club 60 will act to cause the second golf club 60 to pivot or fall downwards about the canopy 20. The grip 64 will move upwards and engages the horizontal spoke 100 and continued upward movement of the grip 64 will be stopped. The second golf club 60 will thus be in engagement with the horizontal spoke 100 and the second club receiving member 88 during retention of the second golf club 60. The horizontal spoke 100 can be made of the same material and of the same size and strength as other portions of the frame 16, or may be made stronger than other frame 16 components.

The first golf club 12 can be retained within the first club receiving member 28 in a manner similar to that previously described with respect to the second golf club 60 and the second club receiving member 88 and a repeat of this information is not necessary. The grip 56 of the first golf club 12 can rest against a horizontal spoke 98 of the frame 16 and be prevented from moving upwards due to the presence of the horizontal spoke 98. With the two golf clubs 12 and 60 oriented approximately 180° from one another, the umbrella 10 will be balanced and easier for transport and holding by the user 52.

The horizontal spokes 98 and 100 onto which the golf clubs 12 and 60 may rest may be the spokes 98 and 100 that are adjacent the respective canopy apertures 26 and 86 or may be spokes 98 and 100 that are farther from the canopy apertures 26 and 86 than other spokes of the frame 16. Further, although shown as being urged against single spokes 98 and 100, in other exemplary embodiments the golf clubs 12 and 60 may rest against multiple spokes of the frame 16. Further, the golf clubs 12 and 60 may engage the same spoke of the frame 16 in accordance with yet additional exemplary embodiments. In some instances, the spokes 98 and 100 are located 180° from one another about the axis of the stem 14. It is to be understood that the golf clubs 12 and 60 may engage any of the spokes of the frame 16 in other exemplary embodiments and that the particular spokes disclosed are only exemplary.

A third golf club 78 is retained by the umbrella 10 as illustrated. The third golf club 78 may be retained within the first club receiving member 28 such that it is right next to and in engagement with the first golf club 12. The shaft 84 can be located in the club receiving member 28 and under the dry space 72. The head 80 of the third golf club 78 may be oriented downwards, and the grip 82 may engage the horizontal spoke 98. The third golf club 78 can be retained by the umbrella 10 the same way as previously discussed with respect to the first golf club 12. Although the presence of the third golf club 78 will introduce some imbalance to the umbrella 10, the amount of imbalance will not be as great as would occur should the umbrella 10 have only a single club receiving member 28 with two or three golf clubs disposed therein. Further, although described as horizontal spokes 98 and 100, it is to be understood that these are terms of convenience and that the spokes 98 and 100 need not be completely horizontal but may have some vertical component to their extension to or from the stem 14.

With reference in particular to FIG. 9, a grip guard 104 may extend from horizontal spoke 100. The grip guard 104 functions to prevent sliding of the grip 64 along the length of the horizontal spoke 100 so that the second golf club 60 is more easily retained thereon. The grip guard 104 may be optional in other exemplary embodiments. The grip guard 104 may be two projections spaced from one another so that enough room is present to accommodate the grip 64 therein. As shown, in order to allow the second golf club 60 to engage the horizontal spoke 100, the second gold club 60 does not extend in a normal direction to the plane of the second canopy aperture 86 but is instead somewhat angled upon extending from the second canopy aperture 86.

A grip guard 102 can be carried by the horizontal spoke 98 in order restrain the movement of the grips 56 and 82 along the horizontal spoke 98 in order to more properly secure the golf clubs 12 and 78. The grip guard 102 may be three projections spaced from one another that extend from the horizontal spoke 98. Grip 56 can be disposed between the middle projection and an end projection, and grip 82 can be disposed between the other end projection and the middle projection. The grips 56 and 82 may or may not engage the grip guard 102, and the grip guard 102 may be optional in accordance with certain exemplary embodiments. Also as illustrated in FIG. 9, the golf clubs 12 and 78 do not extend in a direction normal to the canopy aperture 26 but are instead angled to the canopy aperture 26 so that the grips 56 and 82 can be located on the horizontal spoke 98.

The grip guards 102 and 104 are rigidly attached to the horizontal spokes 98 and 100. However, upon closing of the umbrella 10, the grip guards 102 and 104 face away from the stem 14 so that they do not interfere with closure of the canopy 20, frame 16 or other portions of the umbrella 10.

Hook and loop type fasteners are also employed on the umbrella 10 in FIGS. 8 and 9 to achieve additional functionality. As shown, hooks 106 are located on the exterior surface 44 generally at the top of the club receiving member 28. Corresponding loops 108 are located on the exterior surface 24 of the canopy 20 at a location closer to the top of the stem 14 than the hooks 106. When golf clubs 12 and 78 are not retained by the club receiving member 28, the loops 108 and hooks 106 can be retained onto one another in order to secure the location of the club receiving member 28 to prevent it from becoming tangled. The user may first detach the hooks and loops 106 and 108 and then place the golf club 12 inside the club receiving member 28, or the user 52 may simply insert the golf club 12 and this force will cause the hooks and loops 106 and 108 to disengage one another.

Hooks 110 and loops 112 are also associated with the second club receiving member 88. Hooks 110 are located on the bottom of the exterior surface 96 close to the distal end 90. The corresponding loops 112 are on the exterior surface 24 near the perimeter of the canopy 20. The locations of the hooks and loops 106, 108, 110, and 112 are only illustrated for sake of example and it is to be understood that they can be variously located in accordance with other exemplary embodiments. The hooks and loops 110 and 112 can be engaged when the second golf club 60 is not retained by the second club receiving member 88 so that the second club receiving member 88 is not tangled or otherwise does not interfere when it is not being used.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A device, comprising:

a golf club;

a stem that has an axis;

a frame carried by the stem;

a canopy in an open position that shields a user from rain supported by the frame, wherein the canopy has an interior surface and an oppositely disposed exterior surface, wherein the canopy defines a canopy aperture that extends completely through the canopy wherein the canopy has a perimeter; and a club receiving member that receives at least a portion of the golf club, wherein the club receiving member is arranged in relation to the canopy aperture such that at least a portion of the golf club is disposed through the canopy aperture and located within the club receiving member, wherein a portion of the club receiving member extends beyond the perimeter of the canopy in a radial direction, wherein the distance from the axis to the portion of the club receiving member is farther in the radial direction than the distance from the axis to the perimeter of the canopy in the radial direction.

2. The device as set forth in claim 1, wherein the club receiving member has an interior that is in communication with the canopy aperture such that the portion of the golf club is capable of extending through the canopy aperture and into the interior of the club receiving member.

3. The device as set forth in claim 2, wherein the club receiving member is a flexible sleeve that is closed on a distal end and open on a proximal end, wherein the flexible sleeve extends from the exterior surface of the canopy.

4. The device as set forth in claim 1, further comprising a retaining member that engages the club receiving member that functions to prevent at least a portion of the club receiving member from being moved through the canopy aperture.

5. The device as set forth in claim 4, wherein the retaining member is a string that is attached to the stem.

6. The device as set forth in claim 4, wherein the retaining member is a string that is attached to the canopy and extends from the exterior surface of the canopy to the club receiving member.

7. The device as set forth in claim 1, wherein the golf club is a first golf club and further comprising:

a second golf club;

a second club receiving member that receives at least a portion of the second golf club, wherein the canopy has a second canopy aperture;

wherein the frame has a first horizontal spoke and a second horizontal spoke;

wherein the first golf club engages the first horizontal spoke;

wherein the second golf club engages the second horizontal spoke.

8. A device, comprising:

a golf club; and an umbrella, comprising:

a canopy in an open position that shields a user from rain; and a club receiving member that is a flexible sleeve, wherein at least a portion of the golf club is located within the club receiving member, and wherein the club receiving member functions to keep the golf club dry during rainfall;

wherein the club receiving member has a distal end that is closed, and wherein a canopy aperture is defined completely through the canopy, wherein the golf club extends through the canopy aperture and into the club receiving member, wherein a head of the golf club is located in the club receiving member.

9. The device as set forth in claim 8, wherein the club receiving member is carried by the canopy.

10. The device as set forth in claim 9, wherein the club receiving member is attached to the canopy.

11. The device as set forth in claim 8, wherein the canopy has an interior surface and an oppositely disposed exterior surface, and wherein a grip of the golf club engages the interior surface of the canopy.

12. The device as set forth in claim 8, wherein the golf club is a first golf club and further comprising a second golf club, wherein at least a portion of the second golf club is located within the club receiving member, and wherein the club receiving member functions to keep the second golf club dry during rainfall, and wherein the second golf club engages the first golf club.

13. The device as set forth in claim 8, further comprising:

a second club receiving member located 180° from the first club receiving member about an axial center of the canopy;

a second golf club received within the second club receiving member; and a frame that has a first horizontal spoke and a second horizontal spoke, wherein the first golf club is retained against the first horizontal spoke, and wherein the second golf club is retained against the second horizontal spoke.

14. The device as set forth in claim 8, further comprising a retaining member that is attached to the canopy and to the club receiving member, wherein the retaining member prevents at least a portion of the club receiving member from being moved through a canopy aperture of the canopy.

15. The device as set forth in claim 14, wherein the retaining member is a string.

16. The device as set forth in claim 8, further comprising:

a stem;

a frame attached to the stem, wherein the frame supports the canopy; and a retaining member attached to the stem and to the club receiving member, wherein the retaining member prevents at least a portion of the club receiving member from being moved through a canopy aperture of the canopy, wherein the retaining member is a string.

17. A device, comprising:

a stem that has an axis;

a canopy that can be placed into an open position and a closed position, wherein the canopy has an interior surface that defines a dry space during rainfall when the canopy is in the open position, wherein the canopy has an exterior surface that is engaged by rain during rainfall when the canopy is in the open position, wherein the canopy has a perimeter and is in the open position and shields a user from rain;

a club receiving member that extends from the exterior surface, wherein the club receiving member is a flexible sleeve, wherein the club receiving member has an exterior surface that is engaged by rain during rainfall when the canopy is in the open position, wherein a portion of the club receiving member extends beyond the perimeter of the canopy in a radial direction, wherein the distance from the axis to the portion of the club receiving member is farther in the radial direction than the distance from the axis to the perimeter of the canopy in the radial direction; and a golf club received within the club receiving member, wherein the golf club within the club receiving member is not engaged by rain during rainfall when the canopy is in the open position.

18. The device as set forth in claim 17, wherein the canopy defines a canopy aperture therethrough.

19. The device as set forth in claim 17, wherein the golf club engages the interior surface of the canopy when the golf club is received within the club receiving member, and wherein the golf club does not engage the exterior surface of the canopy when the golf club is received within the club receiving member.

* * * * *